US007334583B2

(12) United States Patent
Niv

(10) Patent No.: US 7,334,583 B2
(45) Date of Patent: Feb. 26, 2008

(54) APPLICATOR FOR HAIR-TREATING PRODUCTS

(76) Inventor: Lundy Niv, 8812 Sudley Rd., Manassas, VA (US) 20110

( * ) Notice: Subject to any disclaimer, the term of this patent is extended or adjusted under 35 U.S.C. 154(b) by 0 days.

(21) Appl. No.: 11/245,023

(22) Filed: Oct. 7, 2005

(65) Prior Publication Data

US 2007/0079843 A1 Apr. 12, 2007

(51) Int. Cl.
*A45D 24/22* (2006.01)

(52) U.S. Cl. ..... 132/116; 132/112

(58) Field of Classification Search ..... 132/112–116; 401/190

See application file for complete search history.

(56) References Cited

U.S. PATENT DOCUMENTS 1,645,038 A * 10/1927 Borer ..... 132/116
2,461,789 A 2/1949 Usai
2,660,182 A 11/1953 Kaul
2,758,606 A 8/1956 Usai
2,857,919 A * 10/1958 Lerner et al. ..... 132/115
3,119,142 A * 1/1964 Fletcher ..... 401/273
3,995,597 A 12/1976 Warwick
4,013,086 A * 3/1977 Chmela ..... 132/110
4,209,027 A * 6/1980 Morganroth ..... 132/212
4,799,456 A * 1/1989 Young ..... 119/603
4,867,183 A * 9/1989 Busch et al. ..... 132/110
5,152,305 A 10/1992 Niv
5,325,878 A * 7/1994 McKay ..... 132/116
6,112,751 A * 9/2000 Bennett ..... 132/116

* cited by examiner

*Primary Examiner*—Robyn Doan
(74) *Attorney, Agent, or Firm*—Clark & Brody

(57) ABSTRACT

An applicator for applying a hair-treatment fluid to hair includes a body portion and a comb portion. The body portion forms a cavity for receiving the hair-treatment material and communicates with the comb portion to apply the material to hair pulled through the comb portion. A distributor valve is placed in the cavity to prevent build-up of the material on the outside of the body portion. The distributor valve preferably rolls and moves transversely in the cavity in response to engagement with the hair to distribute the material more effectively to the hair.

9 Claims, 3 Drawing Sheets

APPLICATOR FOR HAIR-TREATING PRODUCTS

TECHNICAL FIELD

This invention relates to the art of devices for applying liquid or foam products to hair. In particular, the invention relates to an applicator for applying hair-coloring foam to hair.

BACKGROUND ART

Applicators for applying liquid or foam chemical products to hair are known. One such applicator, shown in U.S. Pat. No. 5,152,305, receives a liquid or foam product from a container of the product and applies the product to hair for treating or coloring the hair. The applicator includes a body portion with a cavity that receives the product from the container and a comb-like portion that distributes the product on the hair. The comb is designed to apply the product to the hair in parallel rows to result in a streaked pattern on the hair.

A problem with known applicators, particularly of the type shown in U.S. Pat. No. 5,152,305, is control of the fluid or foam coloring product. If dispensing the product is not properly controlled, the user, whether professional or amateur, might inadvertently allow the product to contact portions of the hair not intended to be colored. It is common for an inexperienced user to allow hair colorant to contact undesired parts of hair, resulting in unwanted splotches of colored hair, instead of the desired clean, professional appearance. One cause of this is the inability of the applicator device to restrict flow of fluid or foam to the desired parts of the applicator.

Applicant has discovered that many less-experienced users of applicators for hair-colorants allow the colorants to accumulate in unintended locations on the applicator. Such accumulated product often inadvertently contacts the hair at unintended locations resulting in an undesired pattern. With reference to FIG. 1, for example, a known applicator 2 such as that shown in U.S. Pat. No. 5,152,305 comprises a body portion 4 and a comb portion 6. The body portion 4 forms a cavity 8 that is supplied with a colorant product 12 from a container 30 attached to an inlet connector 10. The colorant 12 flows into the cavity 8 through the inlet connector 10 and then onto hair 14 through openings in the body portion 4 between adjacent teeth in the comb portion 6. In use, the user pulls the applicator along and through hair 14 as illustrated in FIG. 1 in the direction of the arrow. Thus, the user typically holds the hair 14 in one hand and pulls the applicator with the other hand away from the scalp through hair engaged in the comb portion. The relative motion of the hair with respect to the applicator is from right to left in the view of FIG. 1.

Applicant has found that the device shown in FIG. 1 allows colorant to flow out of the cavity 8 and accumulate on the side of the comb portion downstream with respect to the movement of the hair through the comb portion. The accumulation of colorant is illustrated at 16 in FIG. 1 and presents the problem illustrated in FIG. 2. As illustrated in FIG. 2, the accumulated colorant 16 can inadvertently be deposited on the opposite side of a part 18 in hair 14. This inadvertent deposit often results in a "splotch" of color that detracts from the desired clean application of color highlight.

SUMMARY OF THE INVENTION

In accordance with the invention, an improved applicator is provided with a distributor valve, which prevents the buildup of colorant at 16. The distributor valve is placed in the elongate cavity in the applicator and has a plurality of functions. The transverse size of valve is smaller than that of the cavity Whereby it moves generally toward and away from the cavity inlet in response to engagement with the hair being treated. Thus, when the operator causes product to enter the applicator (e.g., by squeezing a tube of product attached to the applicator) and initially engages hair in the comb portion, the hair will urge the distributor valve toward the inlet. When the hair is disengaged, the distributor valve will drop down, away from the inlet. This motion away from the inlet creates empty space in the cavity into which incoming product can flow, which significantly reduces the tendency of the incoming product to spill out of the applicator into unwanted locations, such as that shown at 16 in FIG. 1.

Further, the distributor valve rolls as the applicator is pulled through hair, which tends to move excess colorant toward the incoming hair and draw it away from the region of accumulation 16. Thus, the distributor valve also distributes product in the cavity to reduce further the potential for accumulation of colorant at 16.

The distributor valve, by these combined functions, significantly reduces the potential for leaving "splotches" by an inexperienced user.

Accordingly, it is an object of this invention to provide a hair treatment applicator that is easier to use.

A further object of the invention is to provide an applicator that reduces accumulation of colorant or other hair treatment product.

A still further object of this invention is to provide an applicator that efficiently applies a hair treating product to hair.

BRIEF DESCRIPTION OF THE DRAWINGS

FIG. 4(*b*) is a transverse cross section of the applicator shown in FIG. 3 during an interval when it is not being pulled through hair.

DETAILED DESCRIPTION OF THE PREFERRED EMBODIMENT

Figure 1:
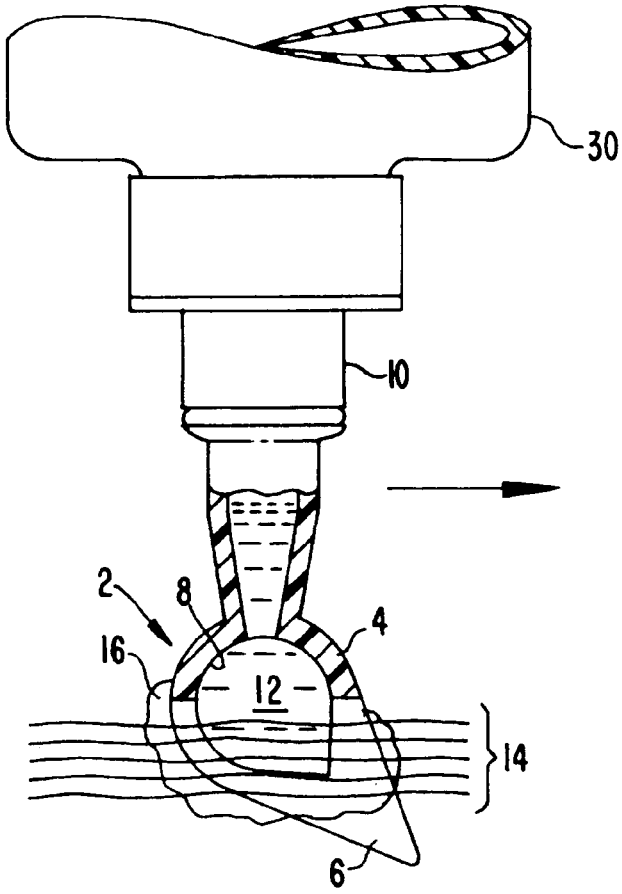
FIG. 1 PRIOR ART
FIG. 1 is a cross section of a prior art applicator.
Figure 2:
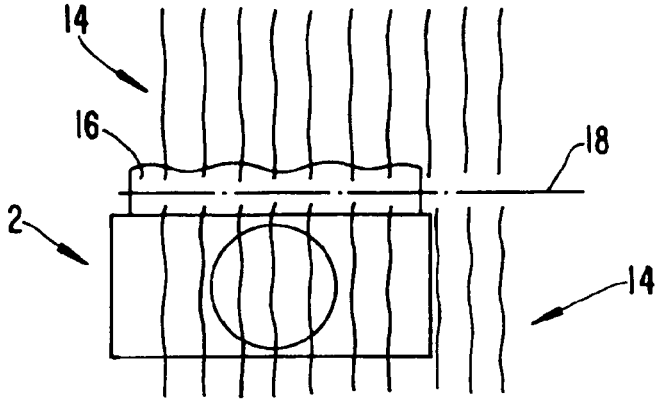
FIG. 2 PRIOR ART
FIG. 2 is a schematic view of use of the applicator of FIG. 1 to apply a hair-treatment product to a person's head.
Figure 3:
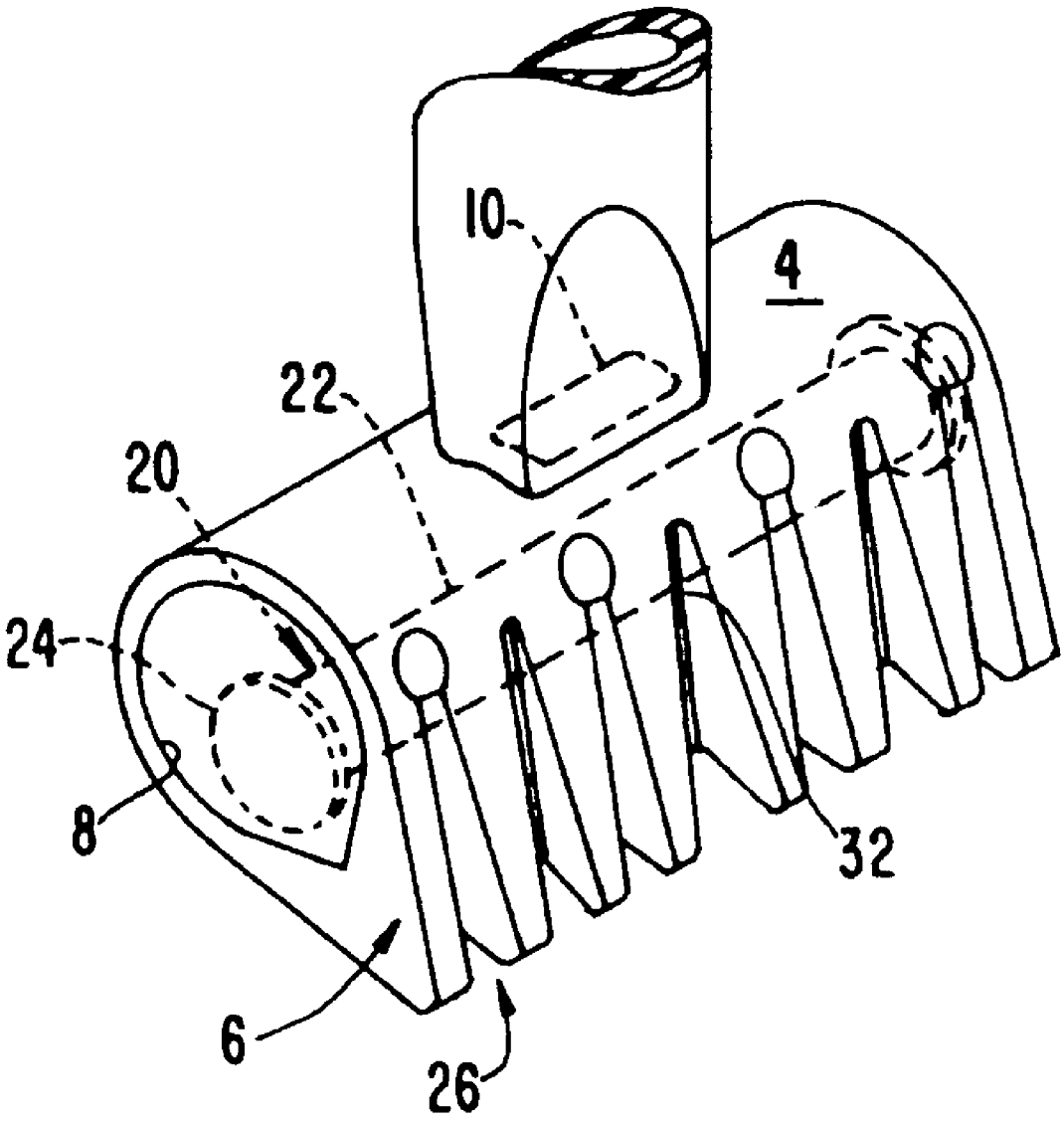
FIG. 3 is a perspective view of an applicator in accordance with the invention.

In accordance with the invention, an applicator shown in FIG. 3 includes a body portion 4, a comb portion 6 and a cavity 8 as described above in connection with FIG. 1. The comb portion 6 is comprised of individual teeth that extend away from the body portion and are positioned generally opposite the inlet 10. That is, the hair-treatment fluid flows into the chamber 8 from the container 30, across the chamber and out slots onto the comb. In a preferred embodiment, the teeth of the comb 6 extend in a direction that forms an angle of about 135° with respect to the direction of the inlet.

The applicator of the invention is further provided with a distributor valve 20 in the cavity 8. The distributor valve 20 generally comprises an elongate element 22 that extends along most of the length of the cavity 8. The element 22 is preferably cylindrical, or tubular to allow it to rotate about its longitudinal axis in response to engagement with hair being pulled through the applicator, but other shapes (e.g., square, oval, polygonal) that allow such motion may also be found to be useful. The transverse dimension (e.g., diameter) of element 22 is small enough relative to the transverse dimension of the cavity 8 such that it can move toward and away from the inlet 10 when the operator holds the tube 30 generally upright.

When the diameter of element 22 is small enough that it may tend to assume a transverse orientation in the cavity, it is desirable to provide a flange 24 at each end to ensure that the element 22 remains generally aligned with the longitudinal axis of the cavity. Otherwise, the distributor valve may become lodged in the cavity and unable to roll or move as desired.

Figure 4A:
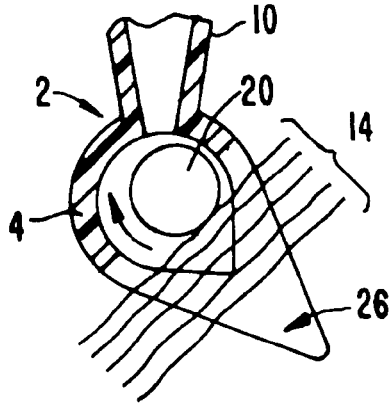
FIG. 4(*a*) is a transverse cross section of the applicator shown in FIG. 3 showing the position of the distributor valve as the applicator is being pulled through hair.
Figure 4B:
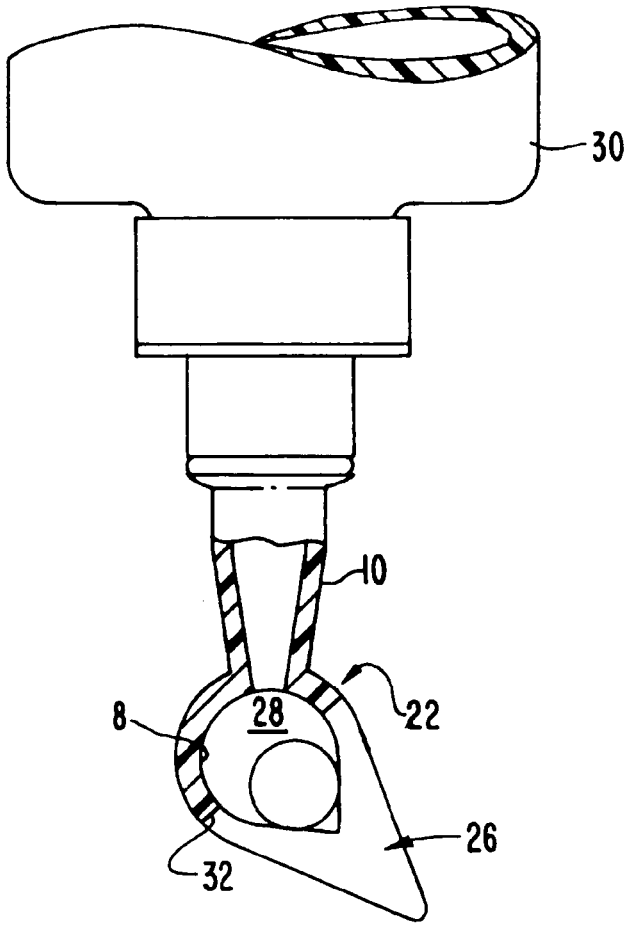

Operation of distributor valve 20 will be described with reference to FIGS. 4(*a*) and 4(*b*). With reference to FIG. 4(*a*), the comb portions that apply the product to the hair include slots 26 that extend into the body portion whereby hair 14 can enter the cavity and push the distributor 20 toward the inlet as shown. This produces two results. First, as the distributor valve is pushed upward by engagement with hair, it displaces some of the product in the cavity, which is applied to the hair as the hair moves through the applicator. The groove terminates at locations 26 in the body portion that allow the hair to 14 to urge the distributor valve into an upper portion of the cavity. Preferably, the grooves terminate at a distance that is about the diameter of the roller element 22 or the flanges 24, when present.

Secondly, the distributor revolves in the direction indicated by the arrow by engagement with the moving hair. This tends to draw the hair-treatment product from the upstream side of the applicator (i.e., the left in FIG. 4) and move it to the downstream side (i.e., the right in FIG. 4). The effect of these motions is to prevent accumulation of the product as shown at 16 in FIG. 1.

Another function of the distributor valve is illustrated in FIG. 4(*b*). When the operator reaches the end of a stroke through the hair, the hair is no longer in the cavity, which removes an upward force on the distributor valve and allows it to assume a position near the bottom of the cavity. This tends to create a space 28 in the cavity above the distribution valve 22, which accommodates any colorant that continues to flow into the cavity from the tube 30. This tends to reduce further the possibility that colorant will be expelled from the cavity into the region 16.

In use, an operator grasps the tube 30 or inlet 10 in the orientation shown in FIG. 4(*a*), applies force to the tube to force hair-treatment fluids into the cavity, and pulls the comb portion through hair to be treated as shown in FIG. 4(*a*). When hair is no longer being pulled through the comb, the operator releases force on the tube 30, while any fluid that continues to flow into the chamber is received in the cavity and not expelled into the comb portion.

It will be appreciated that an improved applicator for hair-treatment products has been described. Modifications within the scope of the appended claims will be apparent to those of skill in the art.

I claim:

1. An applicator for applying a fluid hair-treatment material to hair comprising a body portion and a comb portion, wherein the body portion forms an elongate cavity and has at least one groove between adjacent teeth of said comb portion that provides fluid communication between said cavity and said comb portion and further comprises an inlet for introducing said hair-treatment material into said cavity, said applicator further comprising a distributor valve in said cavity, said distributor valve being configured to contact hair pulled through said comb portion, elongate, and extending along most of the length of said elongate cavity with a maximum transverse dimension smaller than the minimum transverse dimension of said elongate cavity, whereby the distributor valve moves transversely in said cavity and rotates about a longitudinal axis in response to said contact with said hair as said comb portion is engaged with and moved through said hair.

2. An applicator according to claim 1 wherein said distributor valve comprises a tube.

3. An applicator according to claim 2 wherein said tube includes one or more flanges to maintain the desired orientation of said tube in said cavity.

4. An applicator according to claim 2 wherein said comb portion comprises teeth positioned generally opposite said inlet and extending away from said body portion.

5. An applicator according to claim 4 wherein said body portion includes at least one slot adjacent a respective one said of said teeth, said slot extending into said cavity by a distance adequate to allow hair positioned in said groove to push said distributor valve into an upper portion of said cavity.

6. An applicator according to claim 5 wherein said groove terminates a distance from the top of said cavity that is about the diameter of said tube.

7. An applicator according to claim 2 wherein said tube is configured to roll in response to said contact with said hair.

8. An applicator according to claim 7 wherein said tube is configured to move in said cavity toward said inlet in response to said contact with hair.

9. An applicator according to claim 8 wherein said tube is configured to move away from said inlet after removal of said contact with hair.

* * * * *